US011673234B2

(12) United States Patent
Asmolkov

(10) Patent No.: US 11,673,234 B2
(45) Date of Patent: Jun. 13, 2023

(54) KNIFE SHARPENING ANGLE GUIDE

(71) Applicant: MB "PEILIU EKSPERTAI", Vilnius (LT)

(72) Inventor: Roman Asmolkov, Vilnius (LT)

(73) Assignee: MB "PEILIU EKSPERTAI", Vilnius (LT)

( * ) Notice: Subject to any disclaimer, the term of this patent is extended or adjusted under 35 U.S.C. 154(b) by 97 days.

(21) Appl. No.: 17/280,521

(22) PCT Filed: Sep. 11, 2019

(86) PCT No.: PCT/IB2019/057651
§ 371 (c)(1),
(2) Date: Mar. 26, 2021

(87) PCT Pub. No.: WO2020/074979
PCT Pub. Date: Apr. 16, 2020

(65) Prior Publication Data

US 2022/0023999 A1 Jan. 27, 2022

(30) Foreign Application Priority Data

Oct. 9, 2018 (LT) ..... 2018 541

(51) Int. Cl.
*B25B 11/00* (2006.01)
*B24D 15/08* (2006.01)

(52) U.S. Cl.
CPC ..... *B24D 15/08* (2013.01)

(58) Field of Classification Search
CPC ..... B24D 15/08; B24D 15/065; B24B 3/36; B24B 19/002
See application file for complete search history.

(56) References Cited

U.S. PATENT DOCUMENTS

| | | | |
|---|---|---|---|
| 1,269,272 | A | 6/1918 | Floback |
| 2006/0141916 | A1 | 6/2006 | McCowen et al. |
| 2017/0312890 | A1 | 11/2017 | Boutorine |

FOREIGN PATENT DOCUMENTS

| | | | |
|---|---|---|---|
| AU | 2014100926 | A4 | 9/2014 |

OTHER PUBLICATIONS

International Search Report for PCT/IB2019/057651 dated Jan. 23, 2020.

*Primary Examiner* — Lee D Wilson
*Assistant Examiner* — Alyssa R Williams
(74) *Attorney, Agent, or Firm* — Brown & Michaels, PC

(57) ABSTRACT

The invention relates to hand tools of knife sharpening, especially for sharpening of kitchen knifes, namely relates to angle guides for knife sharpening. This angle guide has a removably attachable body that is put on a sharpening rod through a hole going through the body, which has the ability to move back and forth on the rod. The body has guiding cutouts for the blade of a knife that allow to maintain the desired angle against the sharpening rod during the sharpening procedure. At least one pair of cutouts with inclined narrowing cavities are formed in the body on its opposing sides in opposing directions, which allows to alternate between the sides of the blade during the sharpening process and in this way much less burr is produced.

5 Claims, 4 Drawing Sheets

KNIFE SHARPENING ANGLE GUIDE

TECHNICAL FIELD TO WHICH INVENTION RELATES

The invention relates to hand tools for sharpening knives, especially for sharpening kitchen knives, namely relates to a knife sharpening angle guide.

RELEVANT PRIOR ART

US2017312890 (A1) —2017 Nov. 2 describes a knife sharpening angle guide, comprising a body, which is put on the sharpening rod and a fastening means that allows to removably attach the guide on the sharpening rod. This angle guide has at least one guide surface which forms the adjusted angle against the sharpening rod.

The disadvantage of this angle guide is that the adjusted sharpening angle is maintained only when the blade of the knife is against the sharpening guiding surface that is fixated at a particular location of the sharpening rod, for example, near the handle, and when one proceeds with the sharpening motion further along the rod, the angle is controlled by hand and visually only, that is, the device does not ensure that the desired angle is maintained during the whole sharpening motion, which can result in the decrease of the quality of the performance.

AU2014100926 (A4) —2014 Sep. 18 describes a knife sharpening angle guide, comprising a spring and a guide portion. The spring has a first end and a second end, the first end being configured to removably attach to a shaft of the sharpening rod, and the second end is engaged with the guide portion. The guide portion is a body of rigid material which includes an open V-shaped cutout located at the first end of the guide portion. The guide portion further includes a hole which passes through a vertex of the V-shaped cutout with a centreline of the hole extending between two walls of the V-shaped cutout. This way the V-shaped cutout is configured to support a knife blade at a predetermined angle to the centreline of the hole. The knife is sharpened by positioning its blade into one of the cutouts of the angle guide and by applying pressure the knife moves downwards until the end of the rod and then the spring pushes the blade upwards. This motion is then repeated several times and then the knife is repositioned into another cutout and the same motion is repeated several times to sharpen the other side of the blade.

US2006141916 (A1) —2006 Jun. 29 describes an knife sharpening angle guide comprising a body with central hole through which the angle guide is removable attached on the sharpening rod and is movable in both directions along the length of the sharpening rod. At least one guide slot is formed in the body of the angle guide, for receiving a knife blade to be sharpened and during sharpening to position the blade at the predetermined angle with respect to the sharpening rod. During sharpening the blade can move laterally in the slot and the sharpening guide can move longitudinally relative to the sharpening rod. The blade can slidably contact the sharpening surface as it is moved laterally and longitudinally across the sharpening surface. The guide has a spring disposed on the sharpening rod between the lower end of the sharpening guide and the base of the sharpening rod to which one end of sharpening rod is attached. At the beginning of a sharpening stroke the spring is compressed under the pressure of the hand and sharpening guide is moved along the length of the sharpening rod. At the end of the stroke, the user reduces hand pressure on the blade to allow the sharpening guide to move back to the rest position under the force of the spring. This process is repeated until the one side of the blade has obtained the desired sharpness. After that the knife is repositioned into the same slot for sharpening analogously another side of the blade.

The described angle guides, which body has one or two cutouts analogously situated on the different sides of the top end of the guide and the back end of the guide is connected by a spring with a fixating base of the sharpening rod, has a complicated construction and is large in size. Further these angle guides is designed to be used only with a sharpening rod, which has the fixating base, therefore it does not ensure the universality of its applicability as one cannot use the device on other types of rods. The spring used by known devices limits the motion of the guide along the sharpening rod, which makes the sharpening of long blades difficult. As it was mentioned before, the sharpening procedure by using these devices is carried out by first sharpening one side of the blade with multiple repetitions of the same motion and then the same motion is applied to the other side of the blade, which diminishes the quality of sharpening as the burr produced during this process hinders cutting and usually forms at one side of the blade, and when it breaks, the blade becomes dull.

The aim of the invention is to simplify the construction and reduce dimensions of angle guide, to expand the possibilities of applicability and to enhance the quality of sharpening while forming a V-shaped cutting edge of the knife.

DISCLOSURE OF INVENTION

In order to solve the problem according to the present invention a knife sharpening angle guide is proposed, which comprises a body of rigid material, which is removably attachable through a central hole of the body on a sharpening rod and is movable in both directions along the length of the sharpening rod, and inclined guiding cutouts are formed in the body at its opposite sides for receiving a knife blade to be sharpened and to position the knife blade at a predetermined angle with respect to the sharpening rod during the sharpening process of different sides of the blade, wherein the pair of guiding cutouts, each having an inclined narrowing cavity, wherein the guiding cutouts are located at the opposite ends of the body and directed to opposite directions so that the pointed ends of the inclined narrowing cavities of the guiding cutouts of the pair are directed towards the central hole of the body, allowing the blade of the knife to have contact with the sharpening rod at the predetermined angle during the sharpening process, and wider open ends of the inclined narrowing cavities of the guiding cutouts of the pair are directed to outside in the opposite ends of the body.

The body has an elongated shape and its cross section is similar to oval shape, wherein two opposite quarters of the oval are removed to ensure better access of the blade to the sharpening rod.

According to another embodiment of the invention in a body are formed two pairs of guiding cutouts, each of which has an inclined narrowing cavity, wherein the angle of the guiding cutouts with respect to the sharpening rod of the same pair is the same, but the angle of the guiding cutouts of the first pair differs from the angle of guiding cutouts of the second pair, wherein the guiding cutouts of each pair are located at the opposite sides and opposite ends of the body at opposite directions so that the pointed ends of the inclined narrowing cavities of the guiding cutouts of each pair are directed towards the central hole of the body, allowing the blade of the knife to have contact with the sharpening rod at the predetermined angle during the sharpening process, and wider ends of the narrowing cavities of the guiding cutouts of each pair are directed to outside in the opposite ends of the body.

A nozzle is provided for putting it on the tip of the sharpening rod during the sharpening process.

A length of the inclined narrowing cavity of the each guiding cutout is at least two thirds of the height of the knife blade to be sharpened.

Advantages of the Invention

The proposed invention has the following advantages: its construction is very simple and very compact; it is easy to use; it allows to maintain the desired sharpening angle during the full motion of sharpening; it can be used on different sharpening rods as the construction of this device does not require a special foundation to fixate the rod that is required by angle guides that contain a mechanism which uses springs; the angle guide is designed to sharpen knives by alternating the sides of the blade, which results in the burr forming first on one side of the blade and then on the other—this way the burr becomes thinner and thinner and after its removal the blade becomes exceptionally sharp, that is, the sharpening quality while forming a V-shaped cutting edge improves significantly.

The invention is described in much greater detail by the drawings, which do not limit the scope of the invention and contain:

DESCRIPTION OF CARRYING OUT OF THE INVENTION

Figure 1:
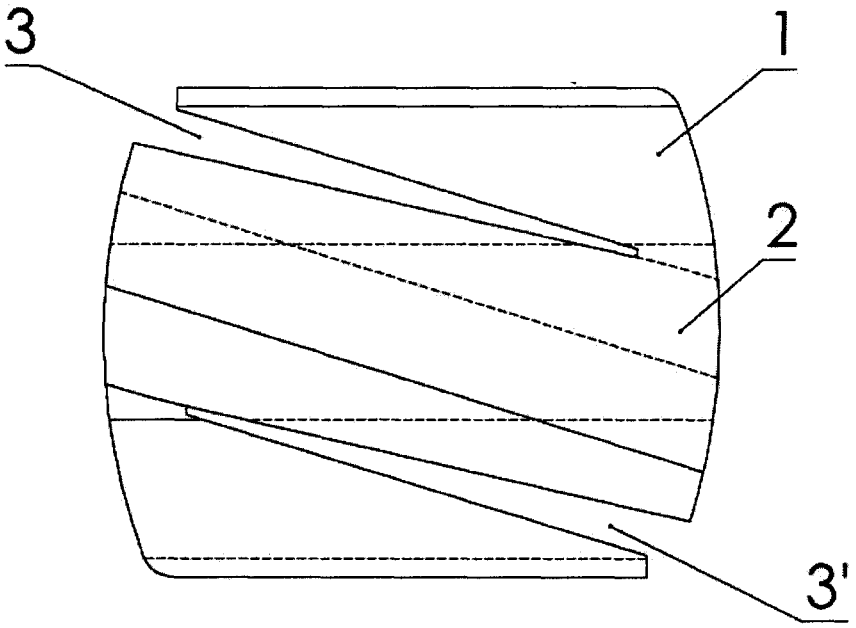
FIG. 1 is a side view of a proposed angle guide.
Figure 2:
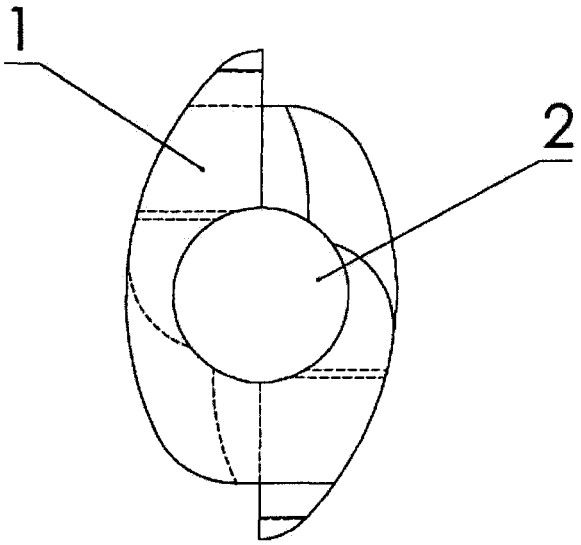
FIG. 2 is a back view of the proposed angle guide.

The proposed sharpening angle guide (FIG. 1-FIG. 4) has a body 1 made from a rigid material, for example plastic, wood, polythene etc. The body 1 has an elongated shape and its cross section is similar to oval shape, wherein two opposite quarters of the oval are removed to ensure better access of the blade to the sharpening rod. The body 1 has a central hole 2 through which the angle guide is removeably positioned onto the sharpening rod with the possibility to move it in both directions along the length of the sharpening rod. A pair of sharpening cutouts 3, 3' is formed in the body 1, wherein each cutout 3, 3' of the pair has an inclined narrowing cavity, which shape and length ensure a stable hold of the blade at the desired angle against the sharpening rod during sharpening process. The length of the inclined narrowing cavity of the each guiding cutout is at least ⅔ of a height of the knife blade to be sharpened to ensure a stable hold of the blade at the predetermined angle during the sharpening process. Mentioned guiding cutouts are located at the opposite sides of the body 1 in a opposite directions. The pointed ends of the inclined narrowing cavities of the guiding cutouts 3, 3' of the pair are directed towards the central hole 2 of the body 1, allowing the blade of the knife to have contact with the sharpening rod at the predetermined angle during the sharpening process, and wider ends of the inclined narrowing cavities of the guiding cutouts 3, 3' of the pair are directed outside to the opposite ends of the body 1.

The cross section of the body 1 together with the shape and length of the guiding cut-outs ensure a comfortable access of the blade to the sharpening surface of the rod and a stable hold. The nozzle 4 is put on the tip of the sharpening rod during the sharpening process to stop the angle guide at the end of the motion.

A proposed sharpening angle guide (FIG. 5-FIG. 8) has a body 1' of elongated shape, which is made from a rigid material. In a center of the body 1' is made a hole 2' through which it is removable positioned onto the sharpening rod with the possibility to move it in both directions along the length of the sharpening rod. The body 1' has two pairs of guiding cutouts (3", 3") and (3'", 3'"), wherein each cutout 3" and 3'" of the each pair has an inclined narrowing cavity. The guiding cutouts 3", 3" of first pair have a same sharpening angle that differs from the sharpening angle of the guiding cutouts 3'", 3'" of the second pair. Using the first pair of guiding cutouts 3", 3" the cumulative cutting edge sharpening angle could be 30 degrees, which would mean that each side of the cutting edge is sharpened against the sharpening rod at a 15 degree angle and using the second pair of guiding cutouts 3'", 3'" the cumulative cutting edge sharpening angle could be 40 degrees, which would mean that each one of the openings would sharpen the cutting edge at a 20 degrees angle against the sharpening rod. The guiding cutouts 3", 3" of the first pair and the guiding cutouts 3'", 3" of the second pair are located at the opposite sides and opposite ends of the body 1' at the opposite directions respectively so that the pointed ends of the inclined narrowing cavities of the guiding cutouts of each pair are directed towards the central hole 2 of the body 1, allowing the blade of the knife to have contact with the sharpening rod at the predetermined angle during the sharpening process, and wider ends of the narrowing cavities of the guiding cutouts 3", 3" and 3'" of each pair are directed outside to the opposite ends of the body 1. The length and shape of the body 1' and the length and shape of the guiding cutouts formed in the body 1' are chosen to ensure stability of the hold of the blade being sharpened at the desired angle during the sharpening process. The nozzle 4' is put on the tip of the sharpening rod to stop the angle guide at the end of the motion.

Use of the Angle Guide

Figure 3:
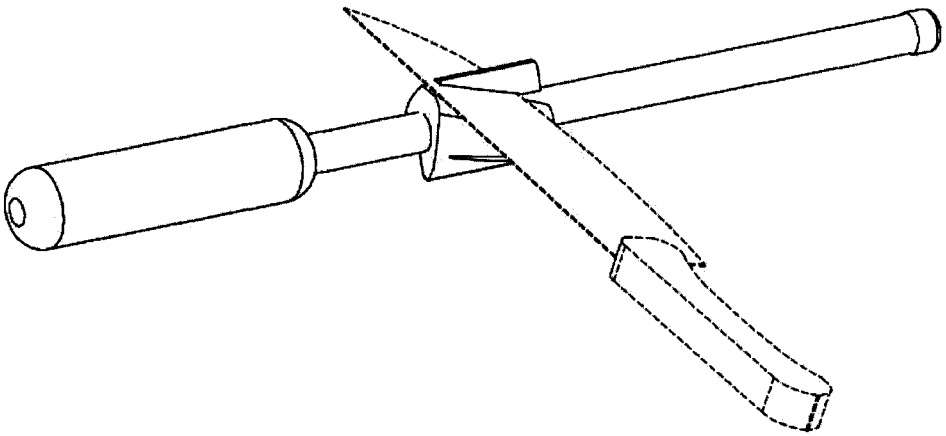
FIG. 3 is a view of the proposed angle guide when it positioned on a sharpening rod with a knife placed in one of the guiding cutouts.
Figure 4:
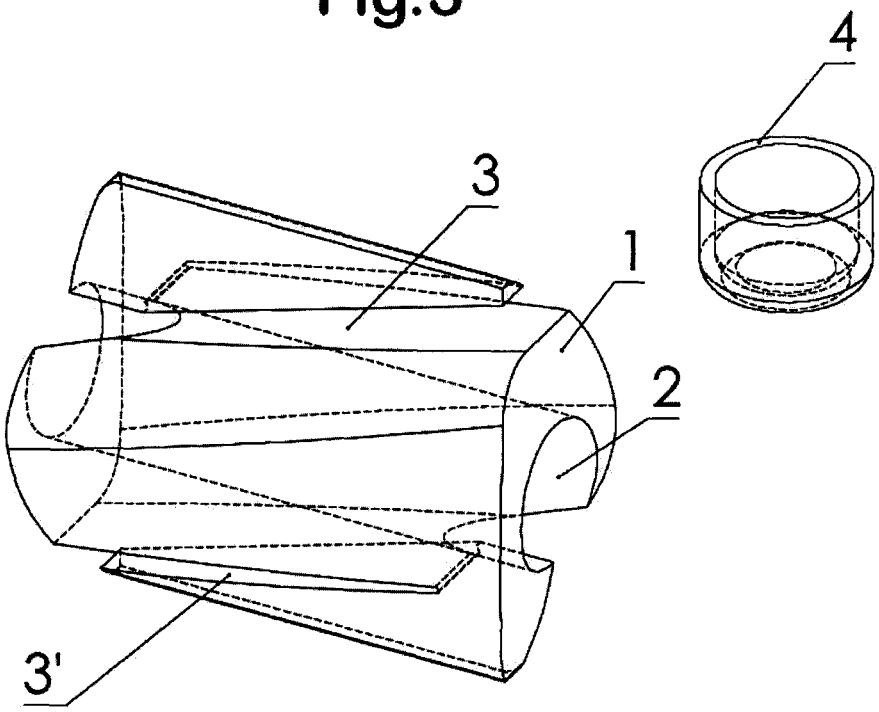
FIG. 4 is an axonometric view of the proposed angle guide.
Figure 5:
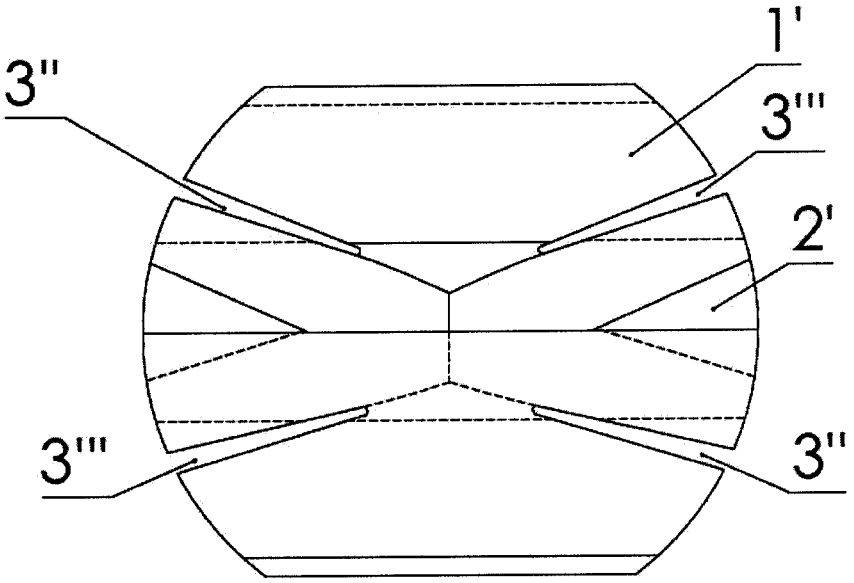
FIG. 5 is a side view of an another embodiment of the proposed angle guide with two pairs of cut-outs.
Figure 6:
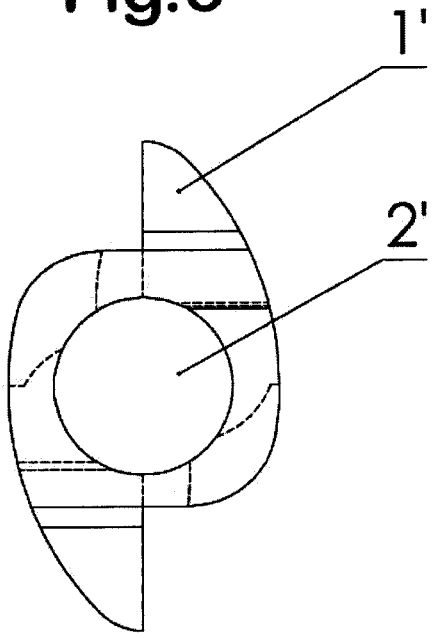
FIG. 6 is a back view of the angle guide according FIG. 5.
Figure 7:
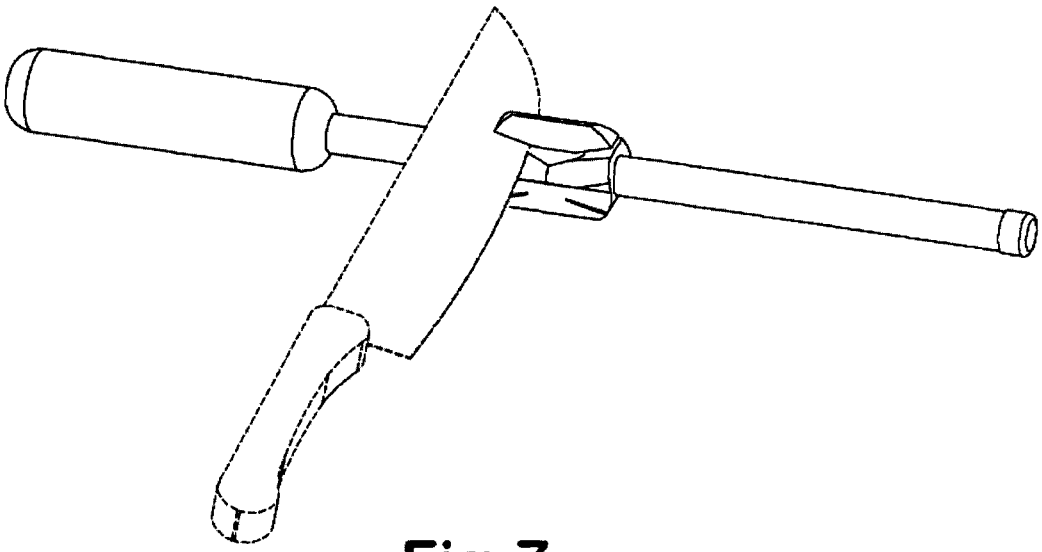
FIG. 7 is a view of the proposed angle guide according FIG. 5 when it positioned on a sharpening rod with a knife placed in one of the guiding cutouts.
Figure 8:
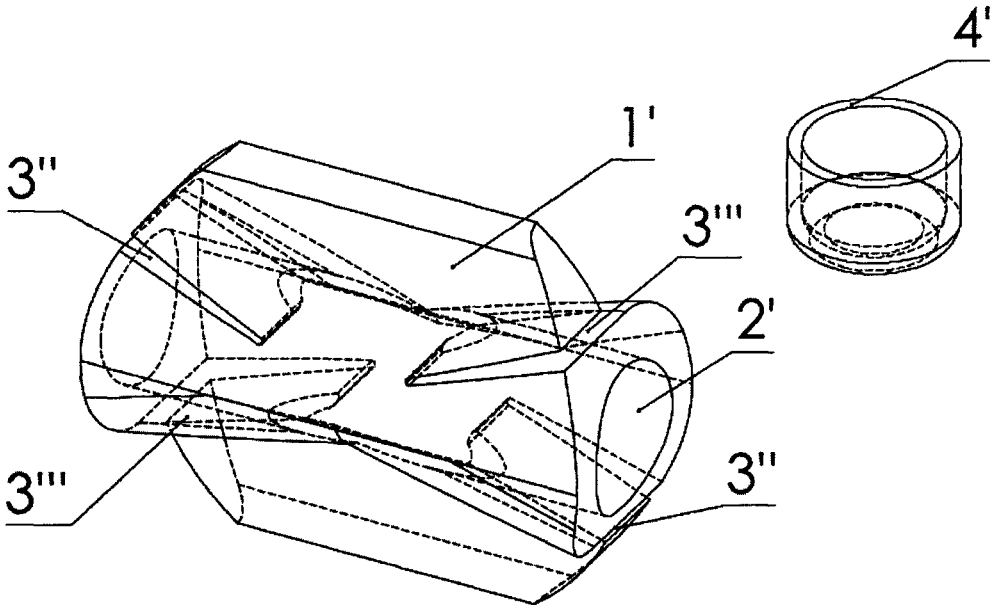
FIG. 8 is an axonometric view of the design of the angle guide according FIG. 5.

The body 1 (FIG. 3) is put on the sharpening rod through the hole 2. The nozzle 4 is fastened at the tip of the sharpening rod. Then the blade of the knife is placed into one of the guiding cutouts 3, 3' (FIG. 1, FIG. 3). When the blade of the knife is placed into the guiding cutout 3 it then has contact with the surface of the sharpening rod at the angle defined by the cutout. While holding the sharpening rod in a horizontal position, the blade of the knife that is in one of the cutouts is pressed against the sharpening rod, starting at the bottom part of the cutting edge and ending at its tip while at the same time the guide moves along the sharpening rod until it is pressed against the nozzle 4'. After the latter motion is completed, the sharpening rod is turned together with the angle guide around its axis by 180 degrees and the blade of the knife is placed into the opposing guiding cutout 3', after which the blade is pressed against the sharpening rod and then with a motion backwards starting at the bottom of the cutting edge and ending with its tip it is sharpened by bringing the angle guide back along the sharpening rod until its handle is reached. The sharpening is processed by alternating from one side to another side of the blade as described above and these motions are repeated until the desired sharpness is achieved.

Using the another embodiment of invention (FIG. 5-FIG. 8) with two pairs of guiding cutouts 3", 3" and 3''', 3''' the sharpening is carried out in an analogous manner as described above. In this case one pick the sharpening angle as one can choose between the guiding cutouts 3", 3" or 3''', 3''', which have different angles against the sharpening rod.

The invention claimed is:

1. A knife sharpening angle guide comprising:

a body of rigid material removably attachable through a central hole of the body on a sharpening rod movable in both directions along a length of the sharpening rod; and inclined guiding cutouts formed in the body for receiving a knife blade to be sharpened and to position the knife blade at a predetermined angle with respect to the sharpening rod during the sharpening process of different sides of the knife blade, each of the guiding cutouts having an inclined narrowing cavity with a pointed end and a wider open end;

wherein the guiding cutouts are located at opposite sides of the body at opposite directions so that the pointed ends of the inclined narrowing cavities of the guiding cutouts are directed towards the central hole of the body, allowing the knife blade to have contact with the sharpening rod at the predetermined angle during the sharpening process, and the wider open ends of the inclined narrowing cavities of the guiding cutouts are directed to an outside of the opposite ends of the body.

2. The knife sharpening angle guide according to claim 1, wherein the body has an elongated shape and an oval cross section with two opposite quarters of the oval are removed to ensure better access of the knife blade to the sharpening rod.

3. The knife sharpening angle guide according to claim 1, wherein in the body the guiding cutouts include a first pair of guiding cutouts and a second pair of guiding cutouts each of the guiding cutouts of the first and second pair of guiding cutouts have the inclined narrowing cavity, wherein an angle of the guiding cutouts with respect to the sharpening rod of the first pair of the guiding cutouts is the same, but the angle of the guiding cutouts of the first pair differs from an angle of the second pair of guiding cutouts, wherein guiding cutouts of the first pair and the second pair are located at the opposite sides and opposite directions so that the pointed ends of the inclined narrowing cavities of the guiding cutouts of the first pair and the second pair are directed towards the central hole of the body, allowing the knife blade to have contact with the sharpening rod at the predetermined angle during the sharpening process, and the wider open ends of the inclined narrowing cavities of the guiding cutouts of the first pair and the second pair are directed to the outside of the opposite ends of the body.

4. The knife sharpening angle guide according to claim 1, further comprising a nozzle for placement on a tip of the sharpening rod during the sharpening process.

5. The knife sharpening angle guide according to claim 1, wherein a length of the inclined narrowing cavity of each guiding cutout is configured for the knife blade to be held at the predetermined angle during the sharpening process.

* * * * *